US006166636A

United States Patent [19]

Herget et al.

[11] Patent Number: 6,166,636

[45] Date of Patent: Dec. 26, 2000

[54] MARKER FOR USE IN A MAGNETIC ANTI-THEFT SECURITY SYSTEM AND METHOD FOR MAKING SAME

[75] Inventors: Matthias Herget, Bruchköbel; Ottmar Roth, Gründau, both of Germany

[73] Assignee: Vacuumschmelze GmbH, Hanau, Germany

[21] Appl. No.: 09/308,286

[22] PCT Filed: Aug. 19, 1998

[86] PCT No.: PCT/DE98/02421

§ 371 Date: May 17, 1999

§ 102(e) Date: May 17, 1999

[87] PCT Pub. No.: WO99/14718

PCT Pub. Date: Mar. 25, 1999

[30] Foreign Application Priority Data

Sep. 17, 1997 [DE] Germany ..... 197 40 908

[51] Int. Cl.[7] ..... G08B 13/14

[52] U.S. Cl. ..... 340/572.6; 340/568.1; 148/310

[58] Field of Search ..... 340/572.1, 572.6, 340/571, 568.1, 551, 567; 148/310, 315

[56] References Cited

U.S. PATENT DOCUMENTS

| | | | |
|---|---|---|---|
| 3,820,104 | 6/1974 | Fearon . | |
| 3,938,125 | 2/1976 | Benassi . | |
| 4,510,489 | 4/1985 | Anderson, III et al. | 340/572 |
| 4,536,229 | 8/1985 | Jin et al. | 148/31.55 |
| 4,960,651 | 10/1990 | Pettigrew et al. | 428/607 |
| 5,313,192 | 5/1994 | Ho et al. | 340/551 |
| 5,539,380 | 7/1996 | Hasegawa et al. | 340/551 |
| 5,653,824 | 8/1997 | Manning et al. | 148/306 |

FOREIGN PATENT DOCUMENTS

| | | |
|---|---|---|
| 0 107 801 | 5/1983 | European Pat. Off. . |
| 0 121 649 | 10/1984 | European Pat. Off. . |
| 0 354 759 | 2/1990 | European Pat. Off. . |
| 0 585 782 | 3/1994 | European Pat. Off. . |
| 0 634 759 | 1/1995 | European Pat. Off. . |
| WO 90/03652 | 4/1990 | WIPO . |
| WO 98/26434 | 6/1998 | WIPO . |

*Primary Examiner*—Jeffery A. Hofsass
*Assistant Examiner*—Daniel Previl
*Attorney, Agent, or Firm*—Schiff Hardin & Waite

[57] ABSTRACT

A marker for employment in a magnetic anti-theft security system is composed of an oblong alarm strip of an amorphous ferromagnetic alloy and at least one activation strip applied onto the alarm strip and composed of a semi-hard magnetic alloy. One or more spatially separated regions that are composed of a non-magnetic phase are introduced into the activation strip with a thermal treatment. The semi-hard magnetic alloy has a coercive force $H_c$ of 15 through 100 A/cm and a remanence $B_r$ of at least 0.8 T.

11 Claims, 1 Drawing Sheet

MARKER FOR USE IN A MAGNETIC ANTI-THEFT SECURITY SYSTEM AND METHOD FOR MAKING SAME

FIELD OF THE INVENTION

The present invention is directed to a marker (also referred to as a tag) for use in a magnetic anti-theft security system, of the type having an oblong alarm-triggering strip composed of an amorphous ferromagnetic alloy, and at least one oblong activation strip applied on the alarm-triggering strip and composed of a semi-hard magnetic alloy.

DESCRIPTION OF THE PRIOR ART

Magnetic anti-theft security systems and markers are adequately known and described in detail in, for example, European Application 0 121 649, and PCT Application, WO 90/03 652. First, there are what are referred to as magneto-elastic systems wherein the activation strip serves of the activation of the alarm strip by magnetizing it; second, there are what are referred to as harmonic systems wherein the activation strip, after being magnetized, serves for the deactivation of the alarm strip.

The alloys with semi-hard magnetic properties that are employed for the pre-magnetization strips include Co—Fe—V alloys that are known, for example, as Vicalloy, Co—Fe—Ni alloys that are known, for example, as Vacozet, as well as Fe—Co—Cr alloys that are known, for example, as Crovac.

These alloys are applied parallel on the alarm strip either as individual sub-segments or as continuous strips.

For activation or, deactivation of the alarm strip, the sub-segments are then magnetized in one direction. For deactivation or, activation of a continuous activation strip, this is magnetized in alternating polarity.

In the magnetization of sub-segments in a direction, a significantly greater distance from the source of the external magnetic field than in the magnetization of a continuous activation strip can be employed due to the directional homogeneity. In the magnetization of a continuous activation strip, this must be brought very close to the source in order to be able to achieve the alternating magnetization. Only a contact activation and not a distance activation, accordingly, can be implemented with a continuous activation strip.

Since, however, there has been a move in the meantime to introduce the markers of the anti-theft security systems directly into the product to be protected (source tagging), the necessity arises of providing the alarm strips with activation strips that can also be magnetized from a greater distance or, with smaller fields. It has been shown that the coercive force of these activation strips must be limited to values of at most 60 A/cm.

The continuous activation strips known from the prior art, however, can only meet this requirement in an unsatisfactory way. In terms of process technology, however, the processing of continuous activation strips has considerable advantages over the application of sub-segments, since the activation strip can simply be applied parallel and durably on the alarm strip.

Given the employment of sub-segments, by contrast, these must either be pre-fabricated or directly applied in individual parts. A pre-fabrication causes higher costs. The application of sub-segments is accompanied by considerable problems in the exact geometrical allocation of the individual sub-segments on the alarm strip.

U.S. Pat. No. 3,820,104 discloses that continuous activation strips that are provided with holes be applied on the alarm strips. These holes simulate a sub-segment structure that allows a distance deactivation.

However, the geometrical allocation of the perforated activation strips on the alarm strips is accompanied by considerable problems. An exact allocation of alarm strip and perforated activation strip can only be guaranteed with a reproducibility of approximately +/−0.5 mm in width. Accordingly, a certain overlap of the holes with the alarm strip is needed, i.e. the diameter of the holes must approximately amount to the bandwidth of the alarm strip plus 1 mm, the bandwidth of the band must amount to this diameter plus a web width of at least 1 mm. This requires a greater use of material and, consequently, increased costs for materials.

SUMMARY OF THE INVENTION

It is an object of the present invention to improve a marker for a magnetic anti-theft security system of the type initially described so that the activation strip thereof so that deactivation at a satisfactory distance with a continuous activation strip is possible in a simple manner.

The above object is achieved in accordance with the principles of the present invention in a marker for a magnetic-anti-theft security system composed of an oblong alarm-triggering strip of an amorphous ferromagnetic alloy, and at least one oblong activation strip applied on the alarm-triggering strip and composed of a semi-hard magnetic alloy, this semi-hard magnetic alloy having one or more spatially separated regions of a non-magnetic phase introduced therein by means of a thermal treatment, and the semi-hard magnetic alloy having a coercive force $H_c$ of 15 through 100 A/cm and remanence $B_r$ of at least 0.8 T.

As a result of such a thermal treatment, phase transitions from a magnetic crystal structure to a non-magnetic crystal structure are induced in suitable semi-hard magnetic alloys. These phase transitions are spatially limited, i.e. a locally limited heat application locally produces a permanent, irreversible non-magnetic condition that leads to a reduction of the effective magnetically conductive crossection.

As a result, the effective magnetically conductive crossection loses the ability of conducting the entire magnetic flux in this region.

The initially cited semi-hard magnetic Fe—Co—Cr alloys have proven especially suitable.

Activation strips are especially well-suited that are composed of 0.1 through 10 weight % nickel, 0.1 through 15 weight % chromium, 0.1 through 15 weight % molybdenum and remainder iron in an overall proportion of iron, nickel and molybdenum of less than 95 weight % of the alloy.

Such alloys can also contain 0 through 10 weight % cobalt and/or at least one of the elements Mn, Ti, Zr, Hf, V, Nb, Ta, W, Cu, Al, Si in individual parts of less than 0.5 weight % of the alloy and/or at least one of the elements C, N, S, P, B, H, O in individual parts of less than 0.2 weight % of the alloy and in an overall part of less than 1 weight % of the alloy. The alloy is characterized by a coercive force $H_c$ of 30 through 60 A/cm and a remanence $B_r$ of at least 0.8 T.

These alloys are excellently ductile and can be excellently cold-worked. Activation strips that have thicknesses of 0.04 through 0.07 mm can be manufactured with these alloys. Further, these alloys are distinguished by excellent magnetic properties and by a high resistance to corrosion.

In a further embodiment, these alloys are semi-hard magnetic alloys that contain 3 through 9 weight % nickel, 5 through 11 weight % chromium as well as 6 through 12 weight % molybdenum.

The pre-magnetization strips are typically manufactured by melting the alloy in a vacuum and casting into a cast block. Subsequently, the cast block is hot-rolled to a ribbon at temperatures above approximately 800° C., process-annealed thereafter at a temperature of approximately 1100°C. and then rapidly cooled. A cold working, expediently cold rolling, subsequently occurs, corresponding to a crossectional reduction of at least 75%, preferably 85% or more. As a last step, the cold-rolled ribbon is annealed at temperatures of approximately 500° C. through 800° C.

In a development of the present invention, this local thermal treatment can ensue with a laser, whereby the interaction time, the beam focussing of the laser and the power of the laser are matched such to the conditions that the zone of thermal influence corresponds to the geometrical dimensions of the spatially separate non-magnetic regions to be achieved.

In an alternative embodiment of the invention, the activation strips, which have not yet been cut to length, are conducted over a heated gearwheel having a gearwheel width which approximately corresponds to the expanse of the non-magnetic regions to be achieved and the spacings of the individual teeth thereof corresponding to the expanses of the magnetic regions. The gearwheel is thereby brought to a temperature that lies above the phase conversion temperature.

DESCRIPTION OF THE PREFERRED EMBODIMENTS

Figure 1:
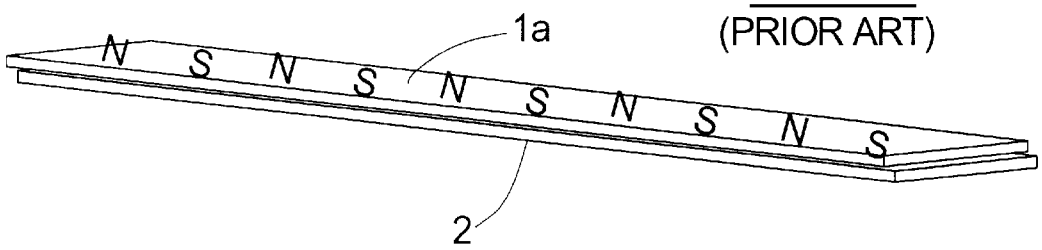
FIG. 1 (PRIOR ART)
FIG. 1 shows an alarm strip and a continuous, oblong activation strip according to the prior art.

FIG. 1 shows an alarm strip 2 with a continuous oblong activation strip 1*a* according to the prior art. The oblong activation strip 1*a* is continuous and magnetized in alternating polarity. The magnetization of the continuous activation strip 1*a* can only ensue satisfactorily when this is brought very close to the source of the external magnetic field. Only an unsatisfactory distance activation or, respectively, distance deactivation is consequently possible with such a continuous activation strip.

Figure 2:
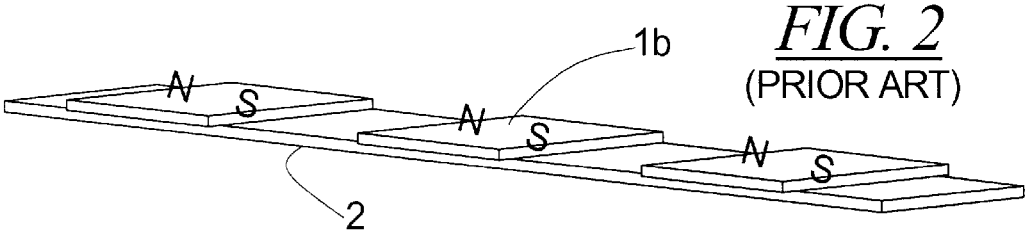
FIG. 2 (PRIOR ART)
FIG. 2 shows an alarm strip with applied sub-segmentation according to the prior art.

FIG. 2 shows a known alarm strip 2 on which a number of sub-segmented activation strips 1*b* are applied. The activation and, deactivation of this alarm strip 2 ensues by magnetization of the sub-segments 1*b*. The magnetization of the sub-segments 1*b* in one direction can ensue with a significantly greater spacing from the source of the external magnetic field. As one can imagine based on FIG. 2, however, the application of these relatively small sub-segments 1*b* onto the continuous alarm strip 2 involves considerable outlay.

Figure 3:
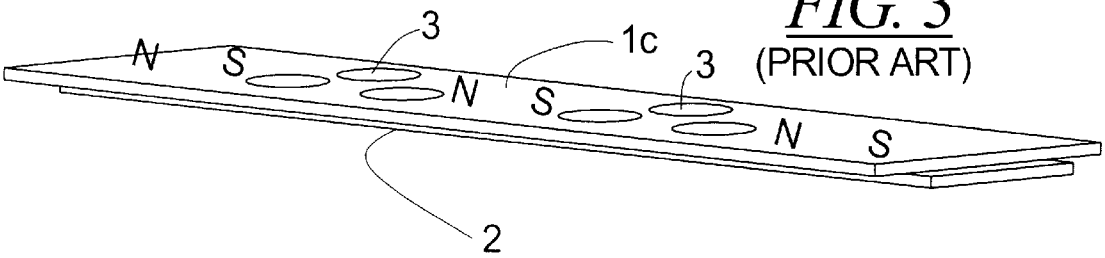
FIG. 3 (PRIOR ART)
FIG. 3 shows an alarm strip with an applied continuous activation strip with perforations, according to the prior art.

FIG. 3 shows a known continuous alarm strip 2 with an applied, continuous activation strip 1*c*. The activation strip 1*c* is provided with holes 3. The sub-segment structure of FIG. 2 is simulated by these holes 3. Here, however, the geometrical allocation of the holes 3 of the activation strip 1*c* on the alarm strip 2 involves considerable problems.

An exact allocation of the alarm strip 2 and the holes 3 of the activation strip can only be assured in a reproducibility of approximately +/−0.5 mm in the width. Accordingly, a certain overlap of the holes 3 with the alarm strip 2 is necessary. The diameter of the holes 3 must amount to approximately the width of the alarm strip 1*c* plus 1 mm; the ribbon width of the activation strip 1*c* must amount to this diameter plus a web width of at least 1 mm. This requires that the activation strip 2 must significantly broader in order to allow a reliable functioning of the label.

Figure 4:
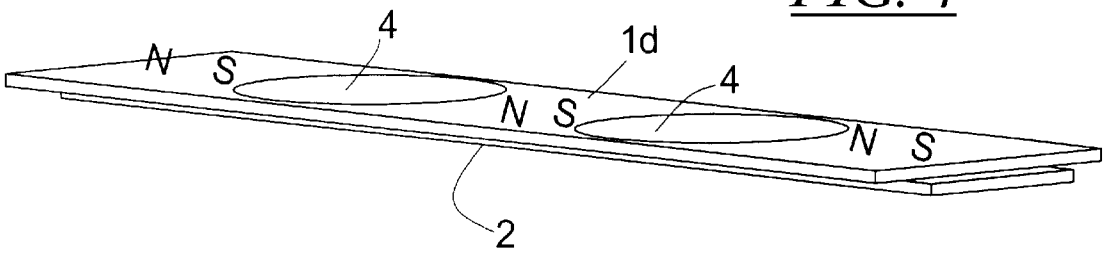
FIG. 4 shows an alarm strip with a continuous applied activation strip constructed and manufactured according to the principles of the present invention.

FIG. 4 illustrates the present invention. As can be seen from FIG. 4, an oblong, continuous activation strip 1*b* is again applied on an oblong, continuous alarm strip 2. Two region 4 that are composed of a non-magnetic phase are introduced into the oblong activation strip 1*d* spatially separated from one another.

These non-magnetic regions 4 are achieved by a thermal treatment of the activation strip 1*d*. Phase transitions from a magnetic crystal structure to a non-magnetic crystal structure are thereby induced in a suitable semi-hard magnetic alloy. These phase transitions are spatially limited, so that the regions 4 have no overlap.

Due to a locally limited heat introduction, accordingly, a permanent, irreversible non-magnetic condition is locally produced that leads to a reduction of the effective magnetically conductive crossection.

As a result, the effective magnetically conductive crossection in these regions 4 losses the ability to conduct the entire magnetic flux.

The semi-hard magnetic activation strip 1*b* shown in FIG. 4 is composed of an Fe—Co—Cr alloy. The activation strips shown in FIGS. 1 through 4 are composed of 0.1 through 10 weight % nickel, 0.1 through 15 weight % chromium, 0.1 through 15 weight % molybdenum and remainder iron in an overall part of iron, nickel and molybdenum of less than 95 weight % of the alloy. The illustrated activation strip 1*d* was manufactured with the following method:

1. casting the alloy at 1600° C.,
2. hot-rolling of the cast block at temperatures above 800° C.,
3. one-hour process annealing at approximately 1100° C.,
4. rapid cooling in water,
5. cold rolling,
6. one-hour process annealing at approximately 1100° C.
7. rapid cooling in water,
8. cold working corresponding to a crossectional reduction of 90%,
9. multi-hour annealing at approximately 650° C., and The activation strips are then thermally treated with a laser in order to achieve the non-magnetic regions.

In an alternative embodiment of the present invention, the activation strips are thermally treated in a continuous process before being cut to length. The activation strips are thereby conducted over a heated gearwheel in a continuous run, the gearwheel width thereof corresponding roughly to the expanse of the non-magnetic regions to be achieved. The spacings of the individual teeth of the gearwheel correspond to the expanses of the magnetic regions. The gearwheel is thereby brought to a temperature that lies above the phase conversion temperature.

Although modifications and changes may be suggested by those skilled in the art, it is the intention of the inventors to embody within the patent warranted hereon all changes and modifications as reasonably and properly come within the scope of their contribution to the art.

What is claimed is:

1. A marker for a magnetic anti-theft security system, said marker comprising:

an oblong alarm-triggering strip composed of an amorphous ferromagnetic alloy;

at least one oblong activation strip composed of a semi-hard magnetic alloy, applied on said alarm-triggering strip;

said activation strip having a length and a strip cross-section perpendicular to said length and having a plurality of spatially separated macroscopic regions each having a non-magnetic phase, and being thermally introduced into said semi-hard magnetic alloy to simulate a segmented structure with sections having an effectively reduced magnetically conductive cross-section, with no strip cross-section containing more than one of said regions; and said semi-hard magnetic alloy having a coercive force $H_c$ in a range between 15 through 100 A/cm and a remanence $B_r$ of at least 0.8 T.

2. A marker as claimed in claim 1 wherein said semi-hard magnetic alloy comprises 0.1 through 10 weight % Ni, 0.1 through 15 weight % Cr, 0.1 through 15 weight % Mo, and Fe such that an overall weight % of Fe, Ni and Mo is less than 95 weight % of said semi-hard magnetic alloy, and said semi-hard magnetic alloy having a coercive force $H_c$ in a range between 30 and 60 A/cm.

3. A marker as claimed in claim 2 further comprising 0 through 10 weight % Co, and at least one of a first element and a second element, said first element comprising less than 0.5 weight % of said semi-hard magnetic alloy and being at least one element selected from the group consisting of Mn, Ti, Zr, Hf, V, Nb, Ta, W, Cu, Al, and Si, and said second element comprising less than 1 weight % of said semi-hard magnetic alloy and comprising at least one element selected from the group consisting of C, N, S, P, B, H and O, with any individual element comprising said at least one second element being less than 0.2 weight % of said semi-hard magnetic alloy.

4. A marker as claimed in claim 1 wherein said semi-hard magnetic alloy comprises 3 through 9 weight % of at least one element selected from the group consisting of Ni and Co, 5–15 weight % Cr, 3–12 weight % Mo, and a remainder Fe.

5. A method for manufacturing an activation strip for a marker in a magnetic anti-theft security system, comprising the steps of:

providing a semi-hard magnetic alloy comprising 0.1 through 10 weight % Ni, 0.1 through 15 weight % Cr, 0.1 through 15 weight % Mo, and Fe such that an overall weight % of Fe, Ni and Mo is less than 95 weight % of said semi-hard magnetic alloy, and said semi-hard magnetic alloy having a coercive force $H_c$ in a range between 30 and 60 A/cm;

melting said alloy in an atmosphere selected from the group of atmospheres comprising a vacuum and a protective atmosphere and casting said alloy into a cast block;

warm-working said cast block into a ribbon, having a length, at a temperature above approximately 800° C.;

annealing said ribbon at a temperature of approximately 1100° C. to obtain annealed ribbon;

rapidly cooling said annealed ribbon to obtain cooled ribbon having a ribbon cross-section perpendicular to said length;

cold-working said cooled ribbon to reduce the cross-section thereof by at least 85% to obtain a cold-worked ribbon;

annealing said cold-worked ribbon at a temperature in a range between 500° C. and 800° C. to obtain a finally annealed ribbon; and simulating a segmented structure in said ribbon containing sections having an effectively reduced magnetically conductive cross-section by producing a plurality of spatially separated, non-magnetic macroscopic regions with a local thermal treatment in said finally annealed ribbon, with no ribbon cross-section containing more than one of said regions.

6. A method as claimed in claim 5 wherein the step of providing a semi-hard magnetic alloy comprises providing a semi-hard magnetic alloy further comprising 0 through 10 weight % Co, and at least one of a first element and a second element, said first element comprising less than 0.5 weight % of said semi-hard magnetic alloy and being at least one element selected from the group consisting of Mn, Ti, Zr, Hf, V, Nb, Ta, W, Cu, Al, and Si, and said second element comprising less than 1 weight % of said semi-hard magnetic alloy and comprising at least one element selected from the group consisting of C, N, S, P, B, H and O, with any individual element comprising said at least one second element being less than 0.2 weight % of said semi-hard magnetic alloy.

7. A method as claimed in claim 5 wherein said local treatment comprises thermally treating said finally annealed ribbon with a laser in a continuous pass.

8. A method as claimed in claim 5 wherein said local thermal treatment comprises conducting said finally annealed ribbon over a gear wheel in a continuous path, said gear wheel having teeth which produce said local thermal treatment of said finally annealed ribbon.

9. A method for manufacturing an activation strip for a marker in a magnetic anti-theft security system, comprising the steps of:

providing a semi-hard magnetic alloy comprising 3 through 9 weight % of at least one element selected from the group consisting of Ni and Co, 5–15 weight % Cr, 3–12 weight % Mo, and a remainder Fe;

melting said alloy in an atmosphere selected from the group of atmospheres comprising a vacuum and a protective atmosphere and casting said alloy into a cast block;

warm-working said cast block into a ribbon, having a length, at a temperature above approximately 800° C.;

annealing said ribbon at a temperature of approximately 1100° C. to obtain annealed ribbon;

rapidly cooling said annealed ribbon to obtain cooled ribbon having a ribbon cross-section perpendicular to said length;

cold-working said cooled ribbon to reduce the cross-section thereof by at least 85% to obtain a cold-worked ribbon;

annealing said cold-worked ribbon at a temperature in a range between 500° C., and 800° C. to obtain a finally annealed ribbon; and simulating a segmented structure in said ribbon containing sections having an effectively reduced magnetically conductive cross-section by producing a plurality of spatially separated, non-magnetic regions with a local thermal treatment in said finally annealed ribbon, with no ribbon cross-section containing more than one of said regions.

10. A method as claimed in claim 9 wherein said local treatment comprises thermally treating said finally annealed ribbon with a laser in a continuous pass.

11. A method as claimed in claim 9 wherein said local thermal treatment comprises conducting said finally annealed ribbon over a gear wheel in a continuous path, said gear wheel having teeth which produce said local thermal treatment of said finally annealed ribbon.

* * * * *